US009493027B2

(12) United States Patent
Sutton

(10) Patent No.: US 9,493,027 B2
(45) Date of Patent: Nov. 15, 2016

(54) ADAPTER FOR WRITING INSTRUMENT OR OTHER SIMILAR INSTRUMENT

(71) Applicant: John Pauk Sutton, Anchorage, AK (US)

(72) Inventor: John Pauk Sutton, Anchorage, AK (US)

( * ) Notice: Subject to any disclaimer, the term of this patent is extended or adjusted under 35 U.S.C. 154(b) by 98 days.

(21) Appl. No.: 14/447,476

(22) Filed: Jul. 30, 2014

(65) Prior Publication Data

US 2015/0037081 A1 Feb. 5, 2015

Related U.S. Application Data

(60) Provisional application No. 61/958,555, filed on Jul. 30, 2013.

(51) Int. Cl.
*B43K 23/00* (2006.01)

(52) U.S. Cl.
CPC ..... *B43K 23/001* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 235,520 | A | * | 12/1880 | Forsyth | B43K 23/004 15/443 |
| 1,206,976 | A | * | 12/1916 | Barth | B43K 23/012 401/8 |
| 3,005,441 | A | | 10/1961 | Glasscock | |
| 4,148,424 | A | * | 4/1979 | Fortenberry | B43K 23/001 15/443 |
| 4,751,923 | A | * | 6/1988 | Marino | A61F 5/3738 128/878 |
| 5,518,486 | A | * | 5/1996 | Sheeler | A63B 21/0004 482/131 |
| 5,722,575 | A | * | 3/1998 | Smith | A45F 5/00 15/443 |
| 5,868,509 | A | | 2/1999 | Crutcher | |

* cited by examiner

*Primary Examiner* — David Walczak
(74) *Attorney, Agent, or Firm* — Kevin D. Jablonski; Lane Powell PC

(57) ABSTRACT

An adapter for attaching a writing instrument or other similar instrument to a person's hand. In one embodiment, the configuration of the adapter allows the writing instrument to be attached to either the thumb or index fin er in such a was that, when the writing instrument is not in use, the writer can still use the hand for office tasks, such as typing on a standard keyboard or using a mouse, without interference from the writing instrument. When the user is ready to use the writing instrument, the writing instrument will move to its original position. Meanwhile, the writing instrument remains handy so that the user does not have to waste time looking for a writing instrument when he or she is ready to resume handwriting or drawing.

6 Claims, 10 Drawing Sheets

ADAPTER FOR WRITING INSTRUMENT OR OTHER SIMILAR INSTRUMENT

PRIORITY CLAIM

This application claims the benefit of U.S. Provisional Application No. 61/958,555, entitled "Koot Adaptor," filed Jul. 30, 2013, which is incorporated herein by reference in its entirety for all purposes.

SUMMARY OF THE INVENTION

This invention relates to adapters for attaching a writing instrument or other similar instrument to a person's hand ("Adapter"). The configuration of the Adapter allows the writing instrument to be attached to either the thumb or index finger in such a way that, when the writing instrument is not in use, the writer can still use the hand for office tasks, such as typing on a standard keyboard or using a mouse, without interference from the writing instrument. When the user is ready to use the writing instrument, the writing instrument will move to its original position. Meanwhile, the writing instrument remains handy so that the user does not have to waste time looking for a writing instrument when he or she is ready to resume handwriting or drawing. Preferably, the Adapter can be used on either the left or right hand by simply changing the direction in which it is oriented with respect to the hand and writing instrument. Preferably, the Adapter is adjustable to suit the size of any thumb or index finger and any writing instrument or other similar instrument.

BRIEF DESCRIPTION OF THE DRAWINGS

Other features and advantages of the present invention will become apparent in the following detailed descriptions of the preferred embodiment with reference to the accompanying drawings, of which.

DETAILED DESCRIPTION OF THE INVENTION

In the description of the invention above and in the detailed description of the invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The Adapter may be used to attach a writing instrument or other similar instrument to a part of a person's hand.

Figure 1:
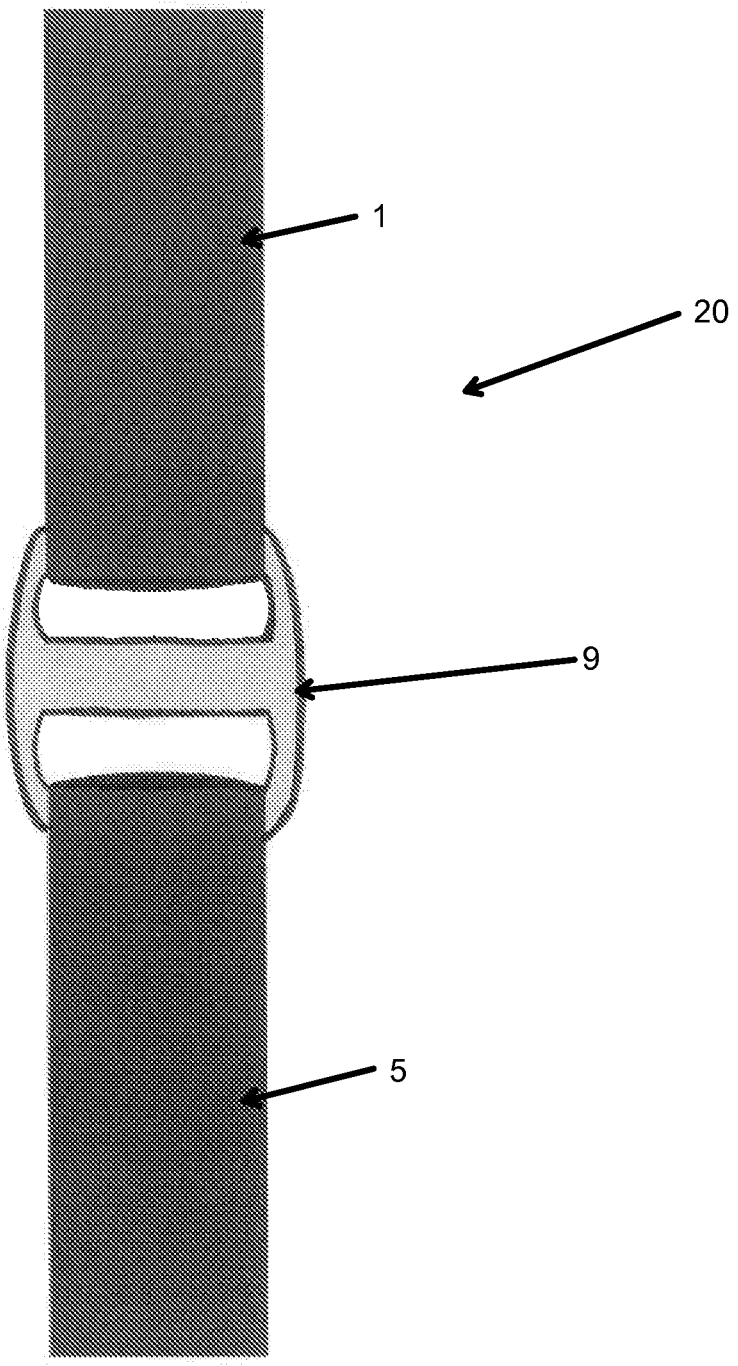
FIG. 1 is a top, perspective view of one embodiment of the adapter.
Figure 2:
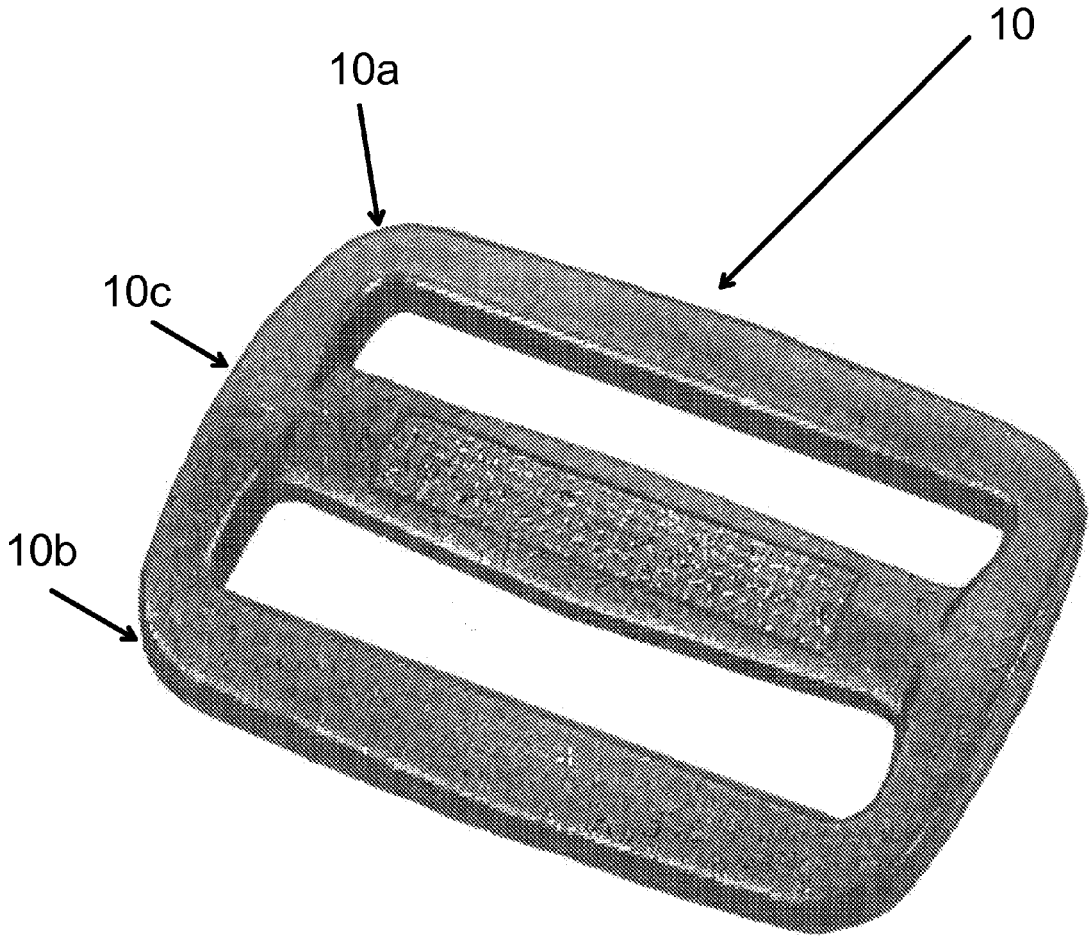
FIG. 2 is an exemplary, perspective view of a tri-glide known in the art.
Figure 3:
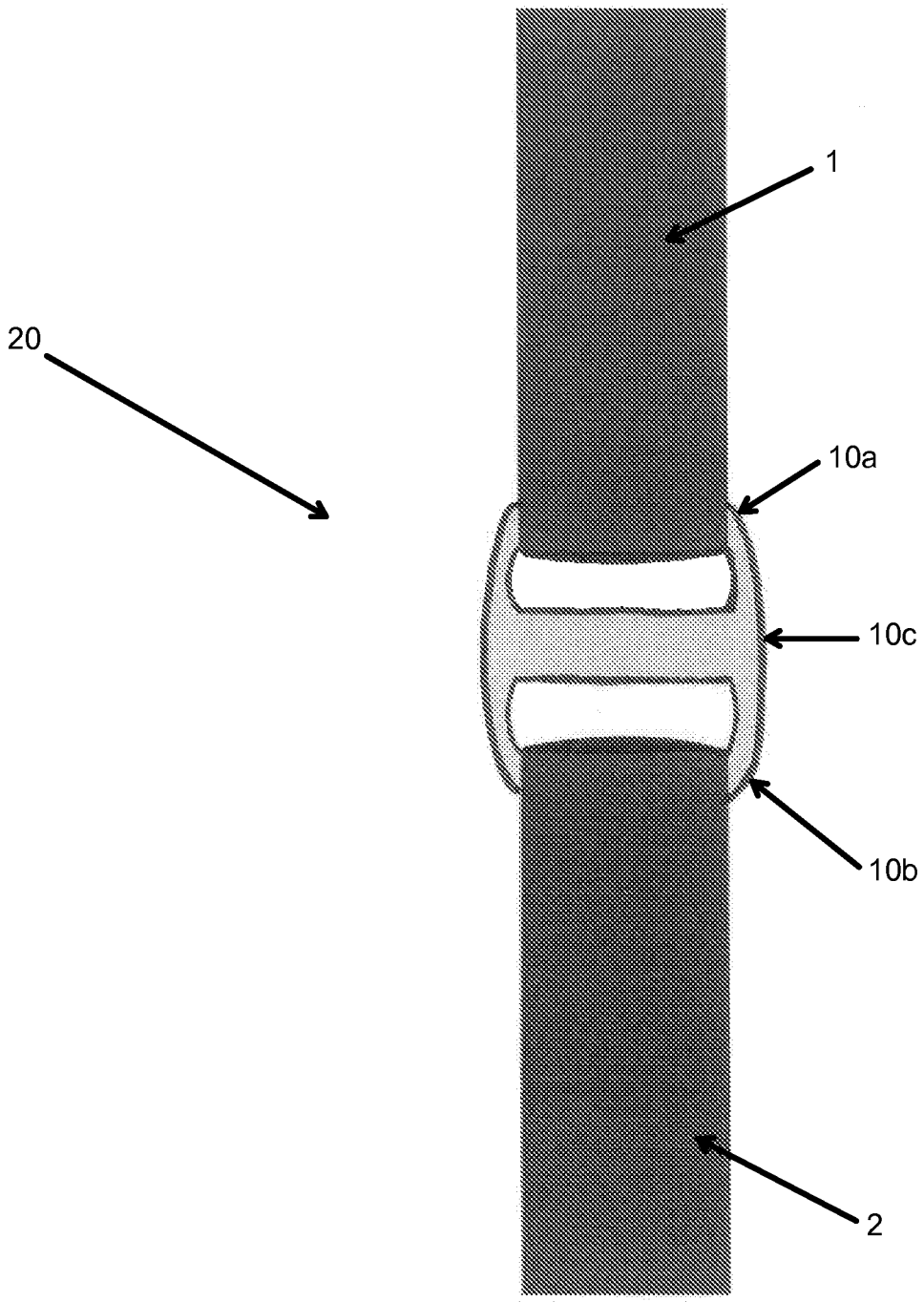
FIG. 3 is a top perspective view of one embodiment of the adapter.

In one embodiment, the Adapter (20) is comprised of a buckling system (9) which is operably attached to a first strap (1) and a second strap (5). Preferably, the buckling system (9) is a tri-glide (10), as shown in FIG. 2; where the first strap (1) is operably attached to portion (10*a*), an end prong of the tri-glide (10), and the second strap (5) is operably attached to portion (10*b*), the other end prong of the tri-glide (10). The first strap (1) may be longer than the second strap (5); where the second strap (5) accommodates a writing instrument. The tri-glide (10) may be made of metal, plastic, or any other material that is sturdy enough for this purpose. The first strap (1) and the second strap (5) may define a Velcro®-like hook and loop system. Alternatively, the first strap (1) and the second strap (5) may be elastic. Preferably, the first strap (1) defines a hook and loop system and the second strap (5) is made from an elastic-type material.

Figure 4:
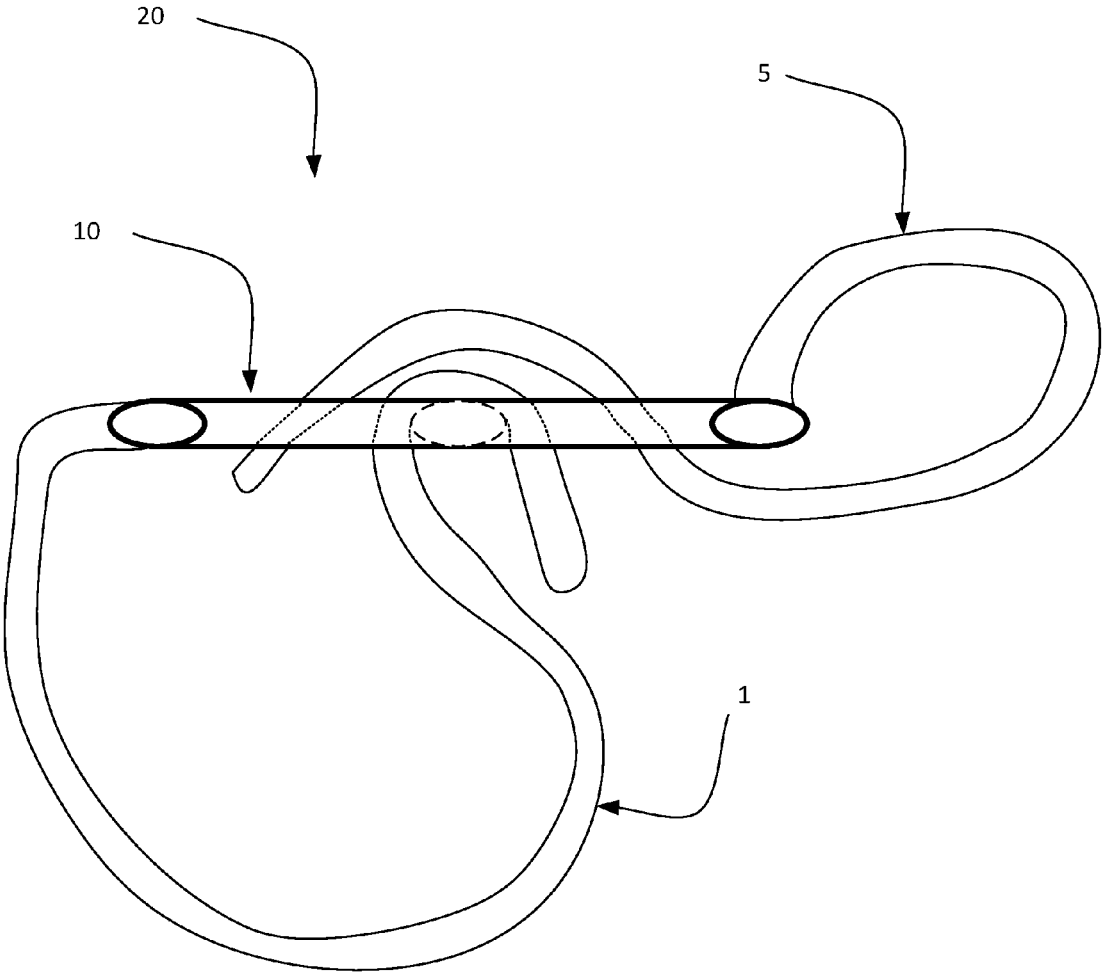
FIG. 4 is a side, perspective view of the adapter in a closed position.
Figure 5:
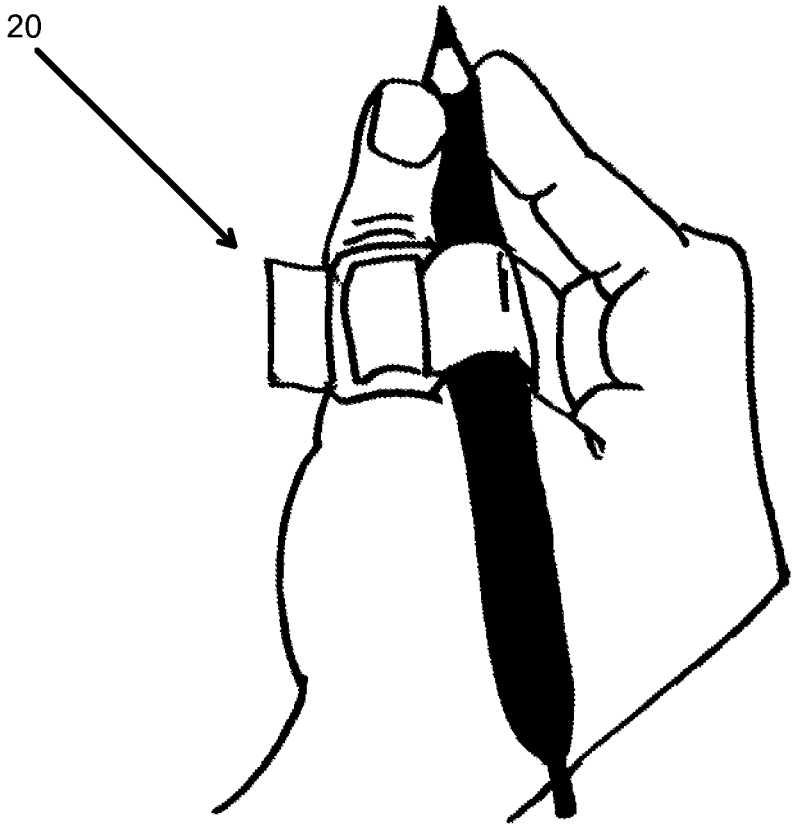
FIG. 5 is an exemplary drawing showing the adapter as used on a thumb.
Figure 6:
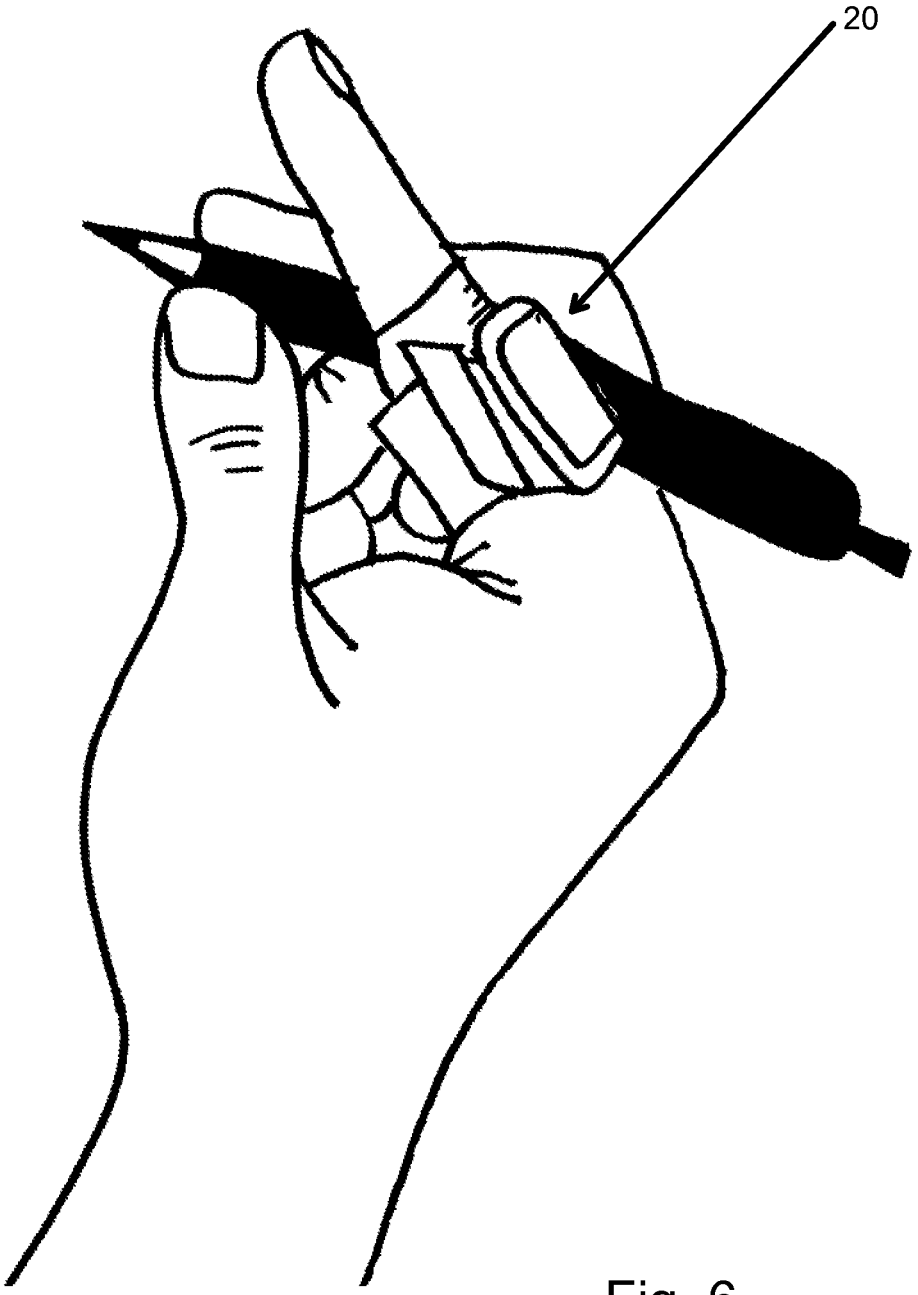
FIG. 6 is an exemplary drawing showing the adapter as used on a forefinger.

Referring to FIGS. 4, 5, and 6, in this embodiment, the user wraps the longer strap, in this case the first strap (1) around the thumb or index finger, and tightens the strap by pulling an end through the tri-glide (10). The shorter strap, in this case, the second strap (5) is wrapped around the writing Instrument and tightened by pulling it through the tri-glide (10). Preferably, the Adapter (20) is positioned on the user's hand when the writing instrument is in the writing position. The Adapter (20) will return the writing instrument to this position when the user is ready to use the writing instrument after a time of non-use.

Figure 7:
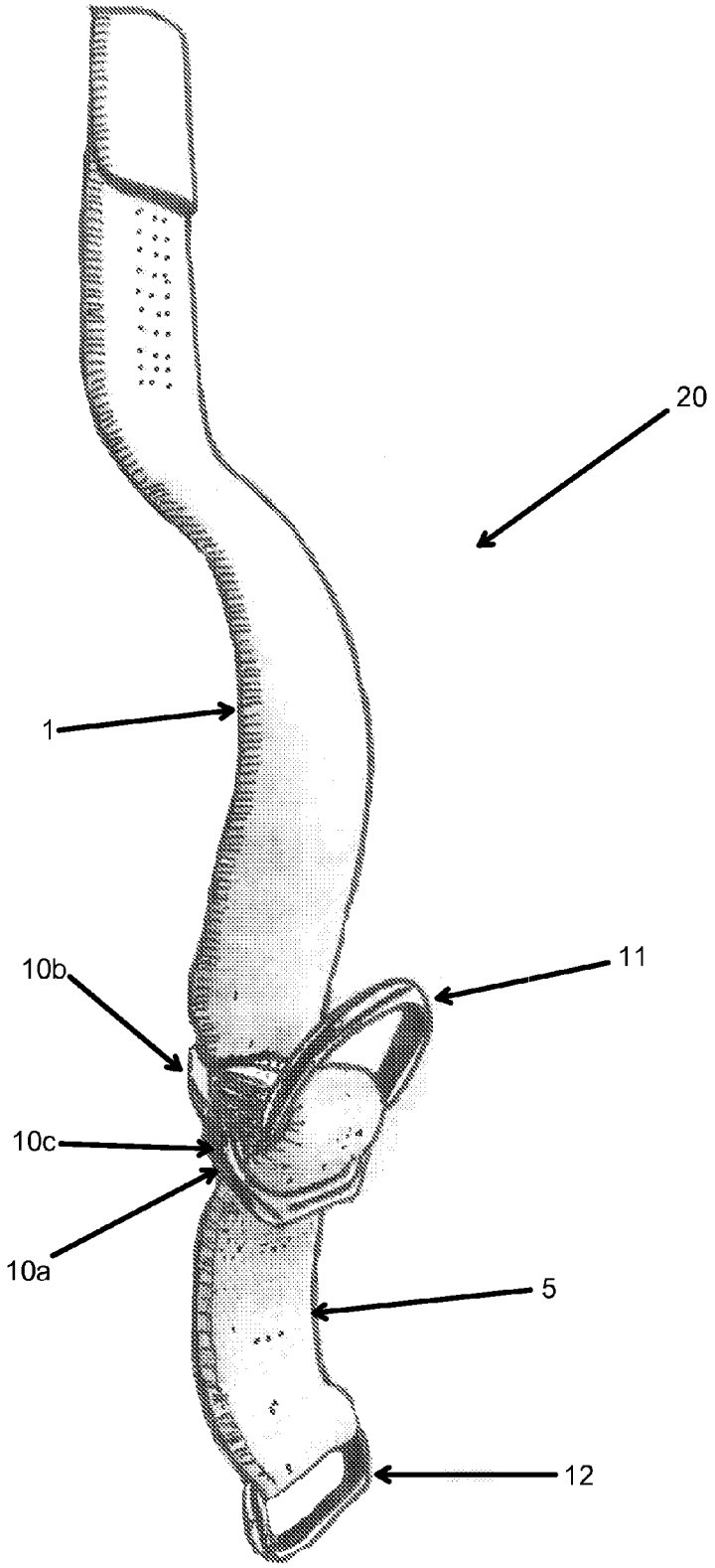
FIG. 7 is a top, perspective view of an embodiment of the adapter.
Figure 8:
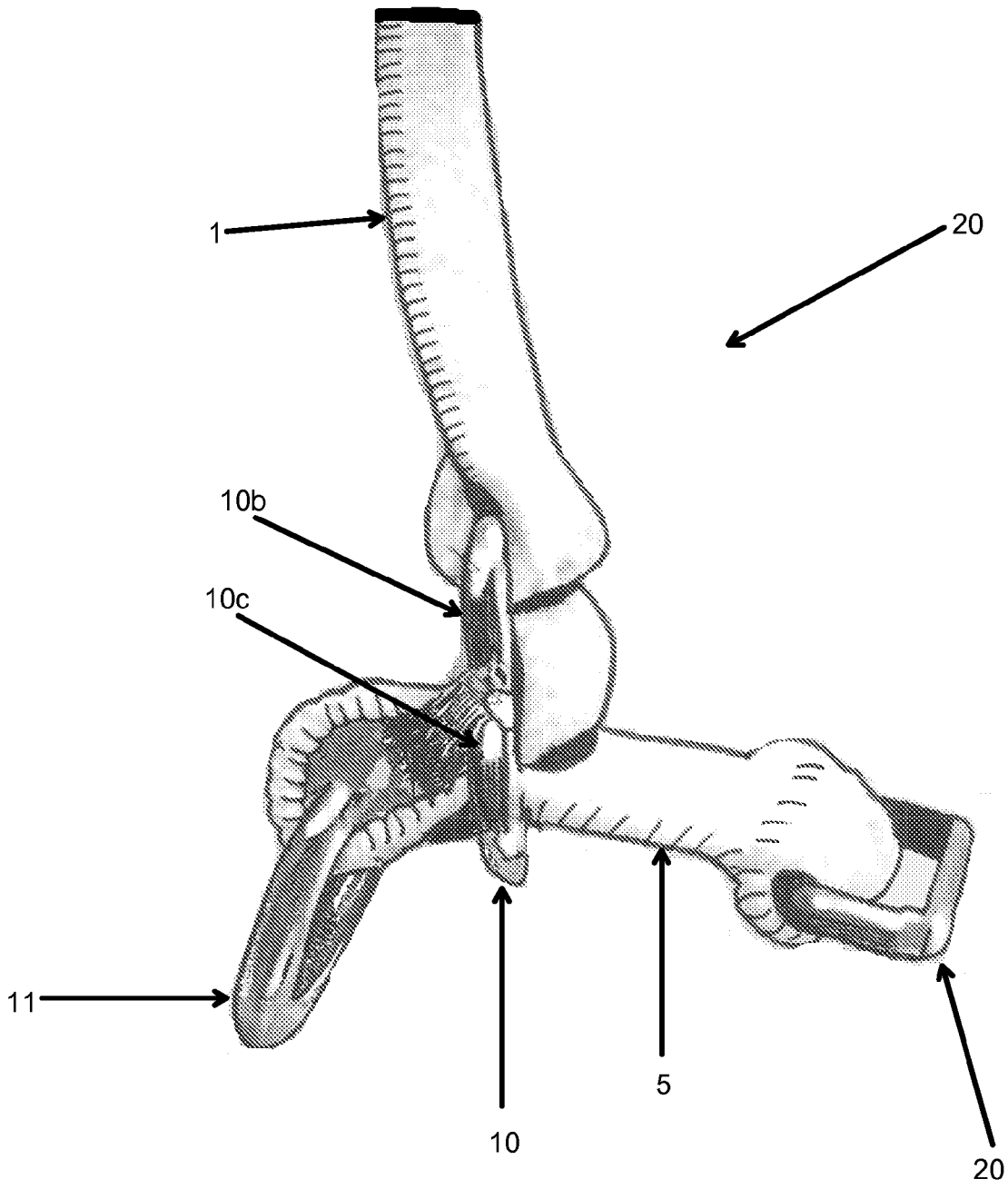
FIG. 8 is a side, perspective view of an embodiment of the adapter.

Referring to FIGS. 7 and 8, in another embodiment, the Adapter (20) is comprised of a tri-glide (10) which is operably attached to a first strap (1) and a second strap (5); where the unattached end of the second strap (5) is woven through a first ring (11) and operably attached to a second ring (12). The first strap (1) is operably attached to portion (10*b*), an end prong of the tri-glide (10), and the second strap (5) is operably attached to portion (10*c*), the center prong of the tri-glide (10). The first strap (1) may be longer than the second strap (5); where the second strap (5) accommodates a writing instrument. The tri-glide (10) may be made of metal, plastic, or any other material that is sturdy enough for this purpose. The first strap (1) and the second strap (5) may define a Velcro® like hook and loop system. Alternatively, the first strap (1) and the second strap (5) may be elastic. Preferably, the first strap (1) defines a hook and loop system and the second strap (5) is made from an elastic-type material. Preferably, the first ring (11) is a "D-ring". The purpose of the first ring (11) is to keep the second strap (5) from slipping when the Adapter (20) is in use.

Figure 9:
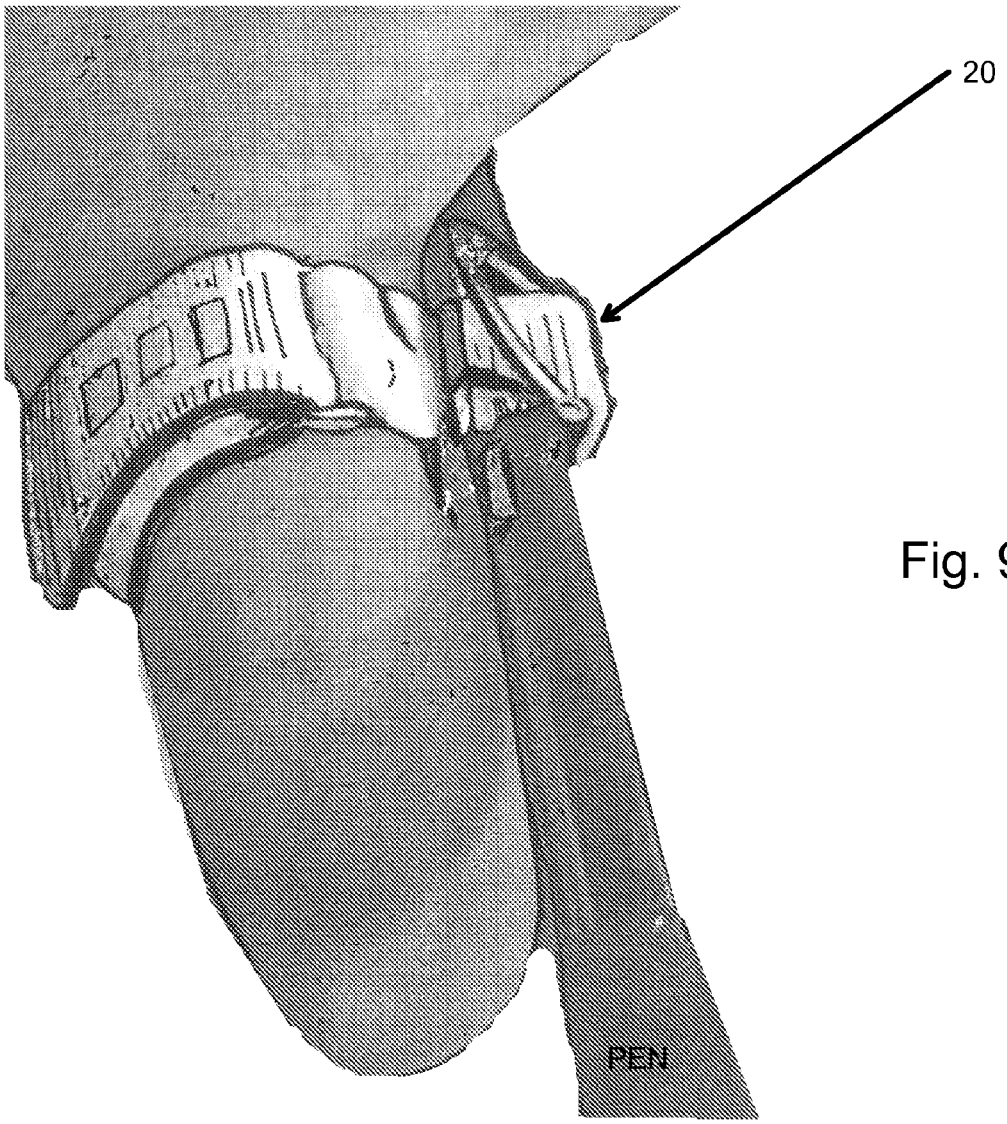
FIG. 9 is an exemplary drawing showing the adapter as used on a thumb.
Figure 10:
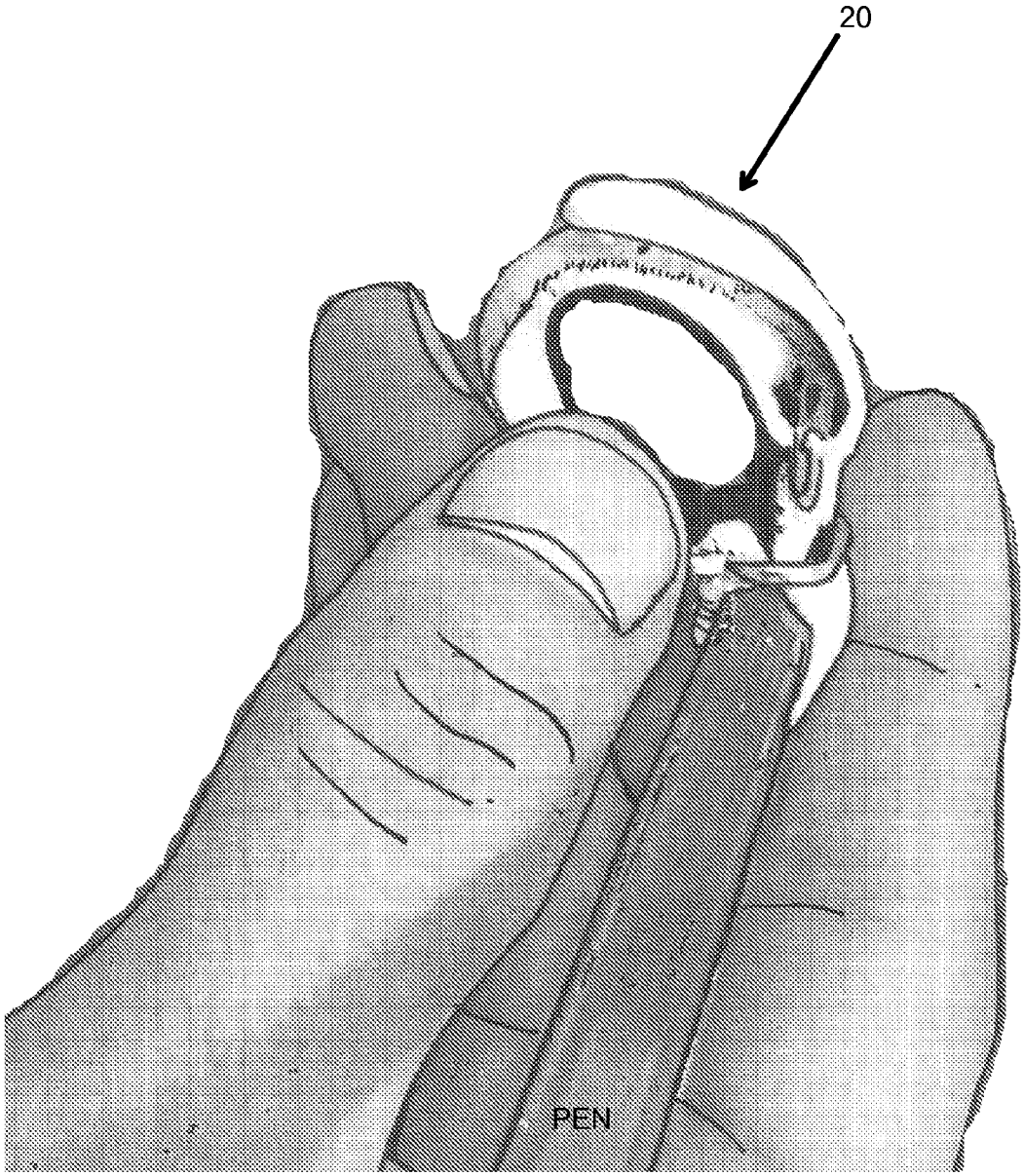
FIG. 10 is an exemplary drawing showing a writing instrument secured onto the adapter.

Referring to FIGS. 8 and 9, in this embodiment, the user wraps the longer strap, in this case the first strap (1), around his thumb or index finger, and tightens the strap by pulling an end through the second ring (12). The shorter strap, in this case the second strap (5), is wrapped around the writing Instrument and tightened by the force exerted on the second ring (12) when the first strap (1) is tightened. Preferably, the Adapter (20) is positioned on the user's hand when the writing instrument is in the writing position. The Adapter (20) will return the writing instrument to this position when the user is ready to use the writing instrument after a time of non-use.

What is claimed is:

1. An adapter for attaching a writing instrument to a user's hand, comprising:

a writing instrument, a buckling system having a first end prong, a second end prong and a middle prong;

a first strap having a first length and a first end operably attached to the first end prong and configured to engage a human thumb by securing an unattached end of the first strap to the middle prong; and a second strap separate from the first strap having a second length less than the first length and a first end operably attached to the second end prong wherein the second strap engages the writing instrument by securing an unattached end of the second strap to the middle prong.

2. The adapter of claim 1 where the buckling system comprises a tri-glide.

3. The adapter of claim 1 where the first strap comprises an elastic material and is securable to the human thumb using a hook and loop material.

4. The adapter of claim 1, wherein one of the first and second straps comprises an inelastic material.

5. The adapter of claim 1, wherein the buckling system comprises metal.

6. The adapter of claim 1, wherein the buckling system comprises plastic.

* * * * *